United States Patent [19]

Lafer

[11] Patent Number: 5,000,510

[45] Date of Patent: Mar. 19, 1991

[54] RECLINING ARMCHAIR

[76] Inventor: Percival Lafer, Rua Garcia Lorca, 301, San Bernardo do Campo SP, Brazil

[21] Appl. No.: 387,288

[22] Filed: Jul. 28, 1989

[30] Foreign Application Priority Data

Jul. 29, 1988 [BR] Brazil ..... 8804019

[51] Int. Cl.[5] ..... A47C 1/02

[52] U.S. Cl. ..... 297/84; 297/68; 297/61

[58] Field of Search ..... 297/84, 83, 68, 71, 297/61

[56] References Cited

U.S. PATENT DOCUMENTS

| | | | |
|---|---|---|---|
| 27,645 | 3/1860 | McGregor | 297/68 |
| 3,086,814 | 4/1963 | Fletcher | 297/84 |
| 3,858,932 | 1/1975 | Crum et al. | 297/83 X |
| 3,880,462 | 4/1975 | Mednick | 297/84 |
| 3,929,374 | 12/1975 | Hogan et al. | 297/61 |
| 4,226,468 | 10/1980 | Johnson | 297/84 |
| 4,270,796 | 6/1981 | Preston | 297/84 X |
| 4,364,603 | 12/1982 | Johnson | 297/84 |
| 4,506,925 | 3/1985 | Crum | 297/84 X |

FOREIGN PATENT DOCUMENTS

| | | | |
|---|---|---|---|
| 466749 | 7/1950 | Canada | 297/83 |
| 760929 | 3/1934 | France | 297/83 |

*Primary Examiner*—José V. Chen

*Attorney, Agent, or Firm*—Darby & Darby

[57] ABSTRACT

A reclining armchair having a seat articulated to a reclining chairback. The chairback is provided with a lower extension interlinked to a foot rest and articulated to the seat. An adjustable head support is assembled over the chairback. The seat (10) and the chairback (20) are articulated to the chassis (50) by pairs of lateral rods (11, 12). The lower end of the head support (40) is articulated to the chassis (50) and to the seat/chairback articulation point by erection rods (42) and erection arms (43) respectively. Movement of the armchair is controlled by a command lever (60) articulated to one lateral column of the chassis (50) and interlinked to the lower end of the chairback (20).

8 Claims, 3 Drawing Sheets

RECLINING ARMCHAIR

The present report refers to a reclining armchair of the type which the inclination of the chair back entails a simultaneous and automatic angular displacement of a forward element, a foot rest for the user.

The type of armchairs in question known so far, present structural characteristics of complex and costly manufacturing, requiring a provision of elements, operation which leads to fatique sooner or later.

Another inconvenience of conventional armchairs refers to the excessive heaviness of its structure associated to dismantling difficulties, thus problematic not only for transportation but also for a simple indoors rearrangement.

Another inconvenience of several of these conventional reclining armchairs refer to the fact that during its dislocation from the normal to a reclining position, its dimension increases in two directions longitudinally, i.e., the armchair extends to the front and back to reach the required reclining resting position. Such situation forces the user to move the armchair to some other position so that the transformation is not obstructed by, as an example, a wall against which the armchair may be placed.

It is the objective of the present invention to produce a reclining armchair presenting simple and resistant construction characteristics at a reduced production cost, light weight and easy transportation.

It is yet another objective of the present invention to produce a reclining armchair presenting a head support as well as foot rest, both triggered automatically and simultaneously by the command of the chairback inclination in relation to the seat by the user, serving such simultaneous and automatic dislocations to provide compatible positions with each reclining situation of the chair, permitting maximum comfort to the user.

Another objective of the present invention is to produce a reclining armchair as a modular unit, allowing for a composition with more than one similar unit, forming a sofa with a number of sittings equal to the amount of armchairs utilized in this composition, being the inclination command of each armchair independently maintained from the other armchairs of the set.

Another objective of the present invention is to provide a reclining armchair which extends itself practically into only one direction during its change from normal to reclining position so that the rearward point (position) of the armchair remains substantially the same in the non-reclining and reclining positions.

This and other objectives and advantages of the present invention are reached with a type of armchair which includes an articulated seat structure to a reclining chair back, being both arranged on a basic chassis of support, and the seat structure articulates a forward foot rest structure displaceable in accordance with the adjusted chairback and an adjustable head support, assembled on the rear part of the armchair.

In accordance with the invention, the seat and the chairback structure are articulated to the basic chassis by a series of side rods placed so that the reclining of the armchair the seat structure and the lower edge of the chairback move forward in substantially horizontal trajet while the upper edge of the chairback dislocates downwards without positioning behind the vertical level corresponding to its non-reclining position, being the head support defined by a vertically sliding structure among guides placed on the chairback and being the lower edge of the head support articulated to the basic chassis in a point dislocated forward, through at least one erection rod and also to the seat/chairback articulating point by means of at least one erection arm, said erection arm and erection rod properly dimensioned to trigger the lifting of the head support structure when the armchair is reclined and provided with a command lever articulated into one of the basic chassis laterals and connected to a lower chairback extension through a manipulating bar.

The invention will be further described in accordance with the annexed designs:

Figure 1:
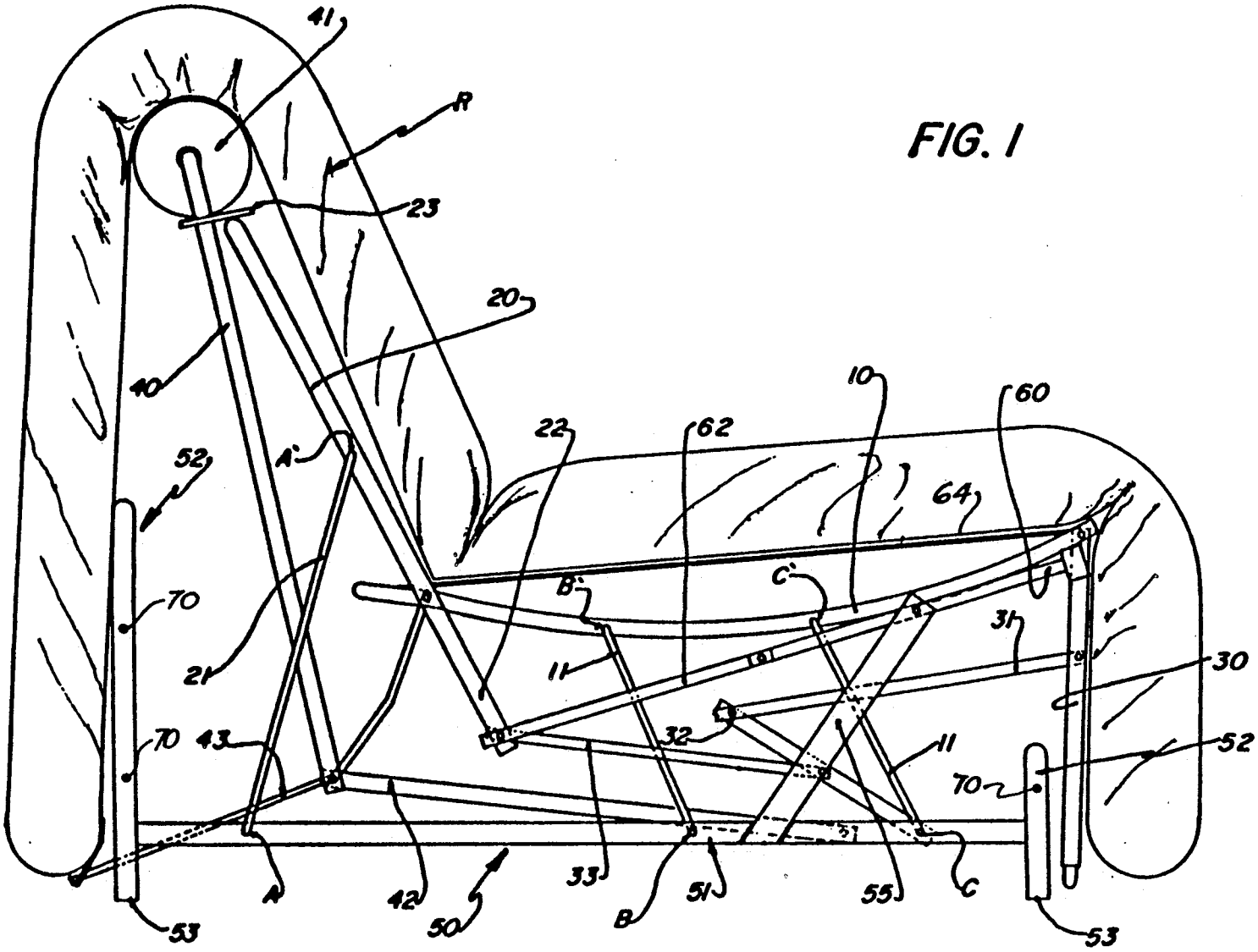
FIG. 1 is a side view of the armchair in question in its normal position.

In accordance with these illustrations this type of reclining armchair includes the seat structure (10) articulated to the reclining chairback (20) being both arranged on a supporting basic chassis (50) being that the seat structure (10) articulates the front foot rest structure (30) and the chairback structure (20) sustains and guides, above, the head support structure (40).

In accordance with the invention the improvement consists in providing a series of rods and articulating arms, interlinking the set, comprising the seat (10) chairback (20) foot rest (30) and head support (40) to the supporting basic chassis (50).

This seat (10) is interlinked to the chassis (50) by two pairs of parallel side rods (11) with its ends articulated to corresponding points B', C', provided on the sides of the seat structure (10) and in points B and C provided on the long beams (51) of the supporting chassis (50). These rods (11) define together with the seat (10) and the chassis (50) a kind of parallelogram so that the seat (10) can be dislocated in a manner generally parallel to the chassis (50).

The reclining chairback (20) is interlinked to the chassis (50) by a pair of rods (21) with its extremes articulated to provided points A—A', respectively, next to the rear extremes of the long beams (51) and the middle portion of the sides of the chairback structure (20).

The foot rest structure (30) articulated to the seat (10) is interlinked to the chassis (50) by a pair of articulating arms (31) each one extremely articulated to the lateral of the foot rest structure (30) and to the same points C of the long beams (51) where the front rods (11) are articulated to the seat support (10).

The articulating arms (31) are provided with medium articulation (32) and linked under the inferior extension of the chairback (20) by an impelling rod (33). The foot rest can be also manufactured in order to allow an automatic adjustment of its longitudinal dimension. In this case the structure of the foot rest includes longitudinal guide means on which a mobile frame slips from an inoperative position entirely overlapping said structure when the foot rest is in a vertical position, to an operationg position in which it is longitudinally displaced forwardly relative to the structure, increasing the longitudinal extension thereof. The head support structure is easily inserted in guides (23) incorporated to the upper portion of the chairback (20) so as to permit a relative displacement between the reclining chairback (20) and head support (40).

This head support (40) defined by an inverted "U" frame, takes into its upper portion, a roller (41) of foam or some similar material, on which the armchair covering is supported R, being the lower extreme of this frame interlinked to the chassis (50) by a pair of erection rods (42), having one extreme articulated to the lower edge of the head support structure (40) and the other extreme to the respective lateral long beam (51) of the chassis (50). The lower edge of the head support structure (40) is also articulated to the seat/chairback articulation point by a pair of erection arms (43) which prolong backwards, so as to have its free extremes secured to the rear portion adjacent to covering R.

In one of the long beams (51) of the supporting chassis (50) is incorporated a lateral vertical column (55) and in its upper portion a command lever is articulated (60). The reclining chairback (20) comprises of an inverted "U" framework articulated to seat (10) so that its lower extreme (22) maintains below the level which contains the seat (10) being such extreme interlinked to the lower one of the commanding lever (60) by a rod of transmission of movement (62).

With such a type of structure, it is obtained through the articulating arms and rods, a simultaneous and harmonic moviment between seat (10) chairback (20) foot rest (30) and head support (40), conception which premits the dislocation between two extreme positions, i.e., normal armchair sitting position and reclining armchair resting position.

All movements relating to the moble parts of the armchair are commanded by the lever (60) which, in the armchair upright position, is maintained practically parallel to the seat level (10) with its transmission rod (62) practically linear with its other transmission rod (33) practically horizontal, maintaining its articulation arms (31) folded into a totally withdrawn position and being the foot rest structure (30) folded, head support withdrawn (40) and chairback (20) in its totally erect position.

In order to change the armchair position from erect into a reclining position, the manual command lever (60) is actioned backwards. By dislocating this lever (60) a light generally horizontal frontward dislocation occurs (10) through parallel dislocation of rods 11 and 21; a distension of the articulating arms (31) lifting the foot rest structure (30); a chairback inclination (20) and a proportional elevation of the head support structure (40) being also angularly dislocated upwards the extremes of the pair of erection arms (43).

Figure 2:
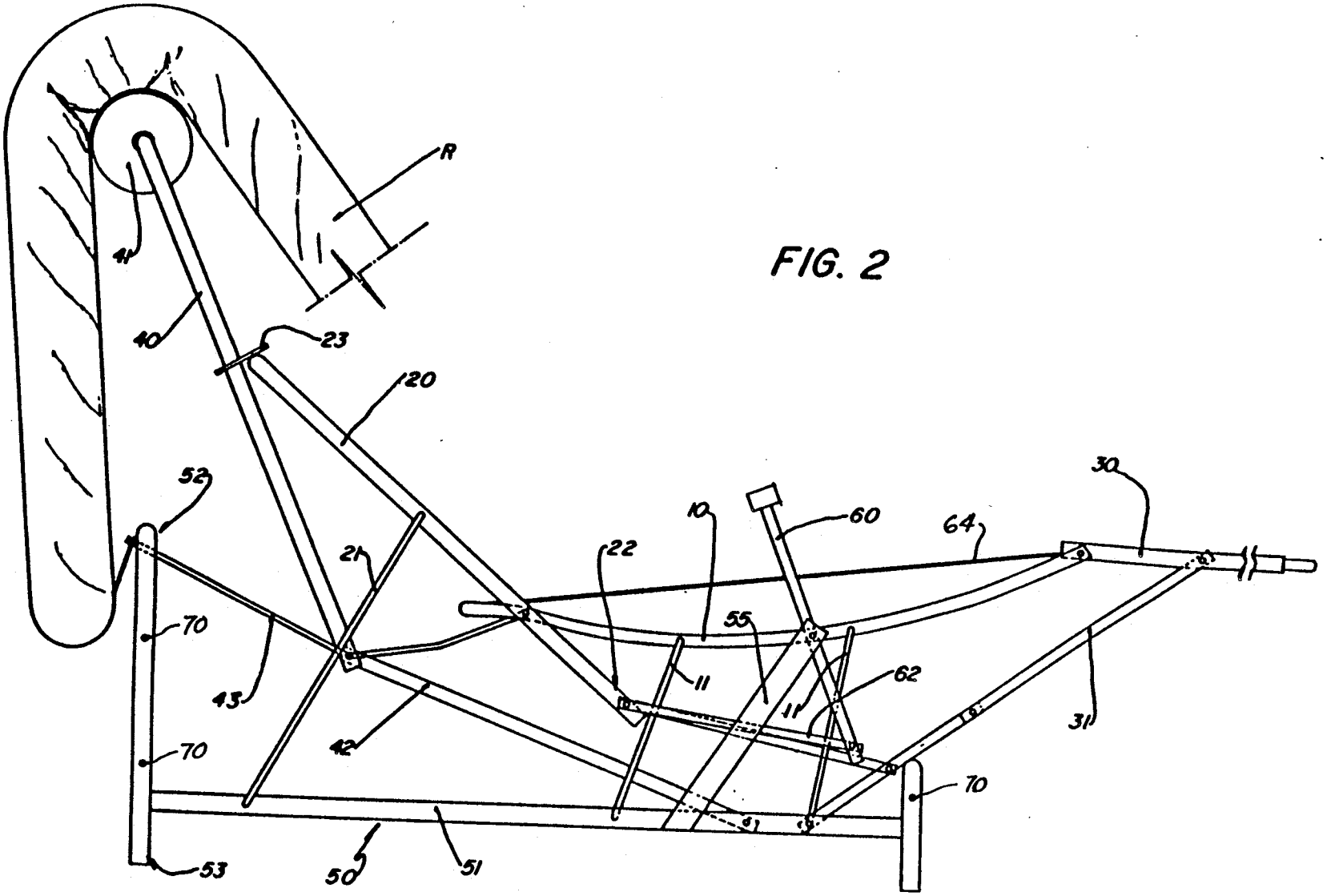
FIG. 2 is a side view of the armchair in its reclining position.

Movement of the erection arms 43, as shown by comparing FIGS. 1 and 2, pushes the covering R upwardly since the covering is connected thereto. The covering R moves around the roller 41 and a portion of the covering R which was previously behind the roller 41 moves to the front of the roller 41 and functions as a head support.

The basic chassis (50) comprises of a pair of long beams (51) with its extremes fixed to corresponding frameworks (52) inverted "U" form, defining the chassis feet (53). The extreme frameworks can sustain the lateral arms (not illustrated) or be laterally fixed to the frameworks extremes of another basic chassis to compose a modular sofa, with modules defined by individually reclining armchairs.

That is, vertical lateral legs 52 have holes 70 (FIG. 2) to receive screw and nut assemblies for connecting the vertical lateral legs of another basic chassis.

The seat structure (10) is preferably arched downwards longitudinally and supplied with elastic elements 64 so as to provide a smooth supporting surface to covering R which takes the form of a long unit, fastened to several points of the armchair, being the extreme rear of the covering R, subject to the action of the erection arms (43) to ease the covering dislocation over the roller (41) of the head support during the armchair movement.

Figure 3:
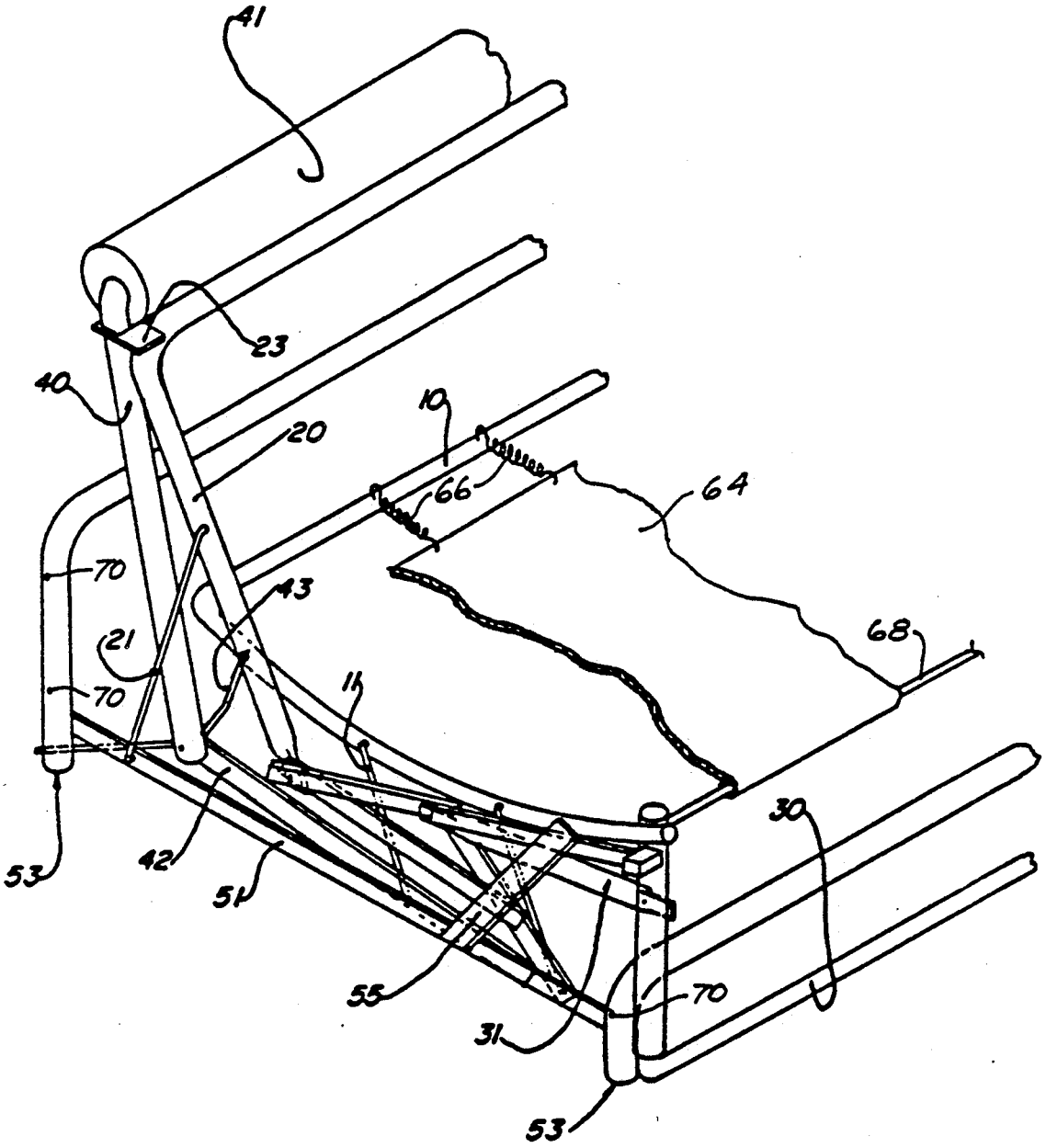
FIG. 3, is a perspective view of the front/lateral partially cut.

As shown in FIG. 3, one end of the elastic elements 64 is connected to seat structure 10 by springs 66 and the other end wraps around rod 68.

I claim:

1. A reclining armchair for resting on a horizontal surface movable from an upright, non-reclining position to a reclining position, comprising a seat connected to a chairback, a foot rest connected to said seat, said chairback provided with a lower extension interlinked to the foot rest, an adjustable head support assembled on the chairback, a chassis for resting on said surface, the seat and the chairback being articulated to said chassis by a pair of lateral rods, said chassis including a plurality of interconnected framework members and beams, said beams being substantially horizontal, the seat and a lower edge of the chairback move forward in a direction substantially parallel to said chassis beams when the armchair is adjusted to its reclining position, and, at the same time an upper edge of the chairback moves downwardly, said head support remaining at substantially the same rearward point relative to said chassis in the armchair's reclining position as in its non-reclining position, the head support being connected to said chassis and disposed rearwardly of said chairback, a guide disposed on the chairback for connecting with said head support, said head support being inserted into said guide, the upper edge of said chairback being subject to sliding downwardly along the head support, constrained by said guide, and the lower edge of the chairback being subject to moving forwardly away from said head support when said armchair moves to said reclining position, an erection rod connected at one end to the lower edge of the head support and articulated at the other end to the chassis, said erection rod connected to an articulating point of said seat and chairback by at least one erection arm, said articulating point being the connection of said chairback with said seat, said erection arm and erection rod being dimensioned to trigger the forward movement of the chairback and the movement of the head support to move the armchair from the non-reclining position into the reclining position, and a lateral column and a command lever articulated to said lateral column of the chassis and connected to the lower edge of the chairback through a transmission rod, said command lever, when activated, pulling said lower edge of said chairback in the forward direction, and providing movement of the lateral rods, erection rod and erection arm to move said armchair into the reclining position.

2. A reclining armchair in accordance with claim 1, wherein the seat is secured to the chassis by two pairs of lateral rods and the chairback is supported on one pair of lateral rods (21).

3. A reclining armchair in accordance with claim 1, further comprising a second erection rod connecting said lower edge of said head support to said chassis, and a second erection arm connecting lower edge of said head support to said articulation point.

4. A reclining armchair in accordance with claim 3, wherein the head support includes an upper roller over which a back portion of a padded covering is placed said covering fixed to the foot rest, seat and chairback.

5. A reclining armchair in accordance with claim 1, wherein the head support includes an upper roller over which a back portion of a padded covering is placed, said covering fixed to the foot rest, seat and chairback.

6. A reclining armchair in accordance with claim 5, wherein a rear portion of the covering is connected to an end of said erection arm opposite to the end connected to said articulating point.

7. A reclining armchair in accordance with claim 1, wherein the seat has a lower longitudinal arched shape and upper elastic devices are connected to said seat at one end, said elastic devices providing a smooth supporting surface to the armchair covering.

8. A reclining armchair in accordance with claim 1, further comprising a pair of lateral long beams with ends fixed to frameworks (52) to define the feet of the chassis, said frameworks being fixable to the frameworks of other basic chassis to compose a modular sofa.

* * * * *